US006027040A

United States Patent [19]

Frye-Hammelmann

[11] Patent Number: 6,027,040

[45] Date of Patent: Feb. 22, 2000

[54] NOZZLE HEAD WITH IMPROVED WEAR-RESISTANT AND SEALING PROPERTIES

[75] Inventor: Hermann Frye-Hammelmann, Oelde, Germany

[73] Assignee: Paul Hammelmann Maschinenfabrik GmbH, Oelde, Germany

[21] Appl. No.: 09/041,941

[22] Filed: Mar. 13, 1998

[30] Foreign Application Priority Data

Mar. 21, 1997 [DE] Germany ..... 197 11 837

[51] Int. Cl.[7] ..... B05B 3/06

[52] U.S. Cl. ..... 239/252; 239/259; 239/264; 239/DIG. 19

[58] Field of Search ..... 239/225.1, 243, 239/245, 251, 252, 263, 264, 381, 383, 380, 461, 548, 259, DIG. 19

[56] References Cited

U.S. PATENT DOCUMENTS 4,391,450 7/1983 Beck ..... 277/1
5,060,862 10/1991 Pacht ..... 239/252
5,060,863 10/1991 Hammelmann ..... 239/252
5,501,396 3/1996 Rohrbacher et al. ..... 239/7

*Primary Examiner*—Andres Kashnikow
*Assistant Examiner*—Jorge Bocanegra
*Attorney, Agent, or Firm*—Henry M. Feiereisen

[57] ABSTRACT

A nozzle head includes a nozzle carrier so mounted to a stationary housing as to allow rotation thereof about a longitudinal axis by a recoil action caused by pressure water exiting spray nozzles accommodated in the nozzle carrier, and a hollow shaft rotatably supported in the housing and secured to the nozzle carrier. The hollow shaft has a central passage for conducting pressure water to the spray nozzles; and has a pressure water connection proximate end face which is supported by a first sealing disk of highly wear-resistant material, e.g. ceramics. The first sealing disk is connected to the hollow shaft via a mounting so as to conjointly rotate with the nozzle carrier and hollow shaft during operation of the nozzle head. The shaft-distal end face of the first sealing disk bears upon a second stationary sealing disk which is also made of a highly wear-resistant material, e.g. ceramics, and received in a mounting which is fixed via a seal ring in the housing.

31 Claims, 1 Drawing Sheet

NOZZLE HEAD WITH IMPROVED WEAR-RESISTANT AND SEALING PROPERTIES

BACKGROUND OF THE INVENTION

The present invention generally relates to a nozzle head, and in particular to a nozzle head of a type having a nozzle carrier supported for rotation about a longitudinal axis and driven by a recoil action caused by pressurized water exiting spray nozzles accommodated in the nozzle carrier, and a stationary housing provided with an inlet for pressurized water and rotatably supporting a hollow shaft which is secured to the nozzle carrier and has a central passage for conducting pressurized water from the inlet to the spray nozzles.

German patent publication DE 38 27 251 A1 discloses a nozzle head of this type, with pressurized water being conducted from the inlet via a sleeve, which extends in an expanded bore in the hollow shaft, to the spray nozzles of the nozzle carrier. Formed between the sleeve and the boundary surface of the expanded bore of the hollow shaft is a labyrinth gap seal formed by circular grooves spaced on the periphery of the sleeve. Despite the provision of the labyrinth gap seal, leakage water, i.e. a partial amount of the pressure medium flows between the sleeve and the hollow shaft and is received in a chamber which is formed with radially outwardly extending discharge bores. A drawback of this conventional nozzle head is the fact that the sleeve is subject to wear and must be replaced periodically.

SUMMARY OF THE INVENTION

It is thus an object of the present invention to provide an improved nozzle head, obviating the afore-stated drawbacks.

In particular, it is an object of the present invention to provide an improved nozzle head which is so designed as to eliminate an outward flow of leakage water and to exhibit substantially increased wear resistance.

These objects, and others which will become apparent hereinafter, are attained in accordance with the present invention by providing a sealing assembly positioned at a nozzle carrier distal end face of the hollow shaft and including a first sealing disk of highly wear-resistant material, with the first sealing disk bearing upon the nozzle carrier distal end face of the shaft and formed with a central passage, a first mounting for so securing the first sealing disk to the shaft as to allow a conjoint movement with the nozzle carrier and the shaft, a second sealing disk made of highly wear-resistant material, with the first sealing disk having an end face proximate to the pressurized water connection and bearing upon an end face of the second sealing disk, and a second mounting fixed in the housing for securement of the second sealing disk.

Through the provision if a such a sealing assembly, a seal is effected between the rotating components of the nozzle head and the stationary components that prevents leakage water from escaping to the outside and substantially improves the wear resistance.

Preferably, the first and second sealing disks are made of ceramic material or of high-strength and wear-resistant bearing material, and the interfaces of the sealing disks are superfinished, preferably polished, so that the friction between the disks is low and an escape of leakage water is substantially eliminated.

The nozzle head with the sealing assembly according to the present invention can be utilized at a working pressure of the pressure medium ranging between 1,000 bar and 3,500 bar.

According to another feature of the present invention, the first and second mountings are preferably made of steel, with the second mounting being so secured by a sealing ring in the stationary housing as to be prevented from executing a rotational motion.

Preferably, the central passages of the shaft and the first sealing disk are slightly offset to one another, e.g. by 1 mm.

According to still another feature of the present invention, the second sealing disk has another end face directed toward the pressurized water connection and shaped of convex configuration, with the sealing assembly including a support body having an end face exhibiting a concave configuration and bearing upon the convex end face of the second sealing disk. The support body may be so mounted in the housing as to be slidable by a slight stroke, with the other end face thereof which is proximate to the pressurized water connection being acted upon by pressurized water. A sealing ring is suitably provided and positioned in a receptacle of the housing for bounding the other end face of the support body toward the outside.

The support body may be formed with a central passage, with a further sealing ring made of rubber or plastics being positioned between the support body and the adjacent second sealing disk and so received in a receptacle of the support body as to circumscribe the central passage of the support body.

According to another feature of the present invention, the first mounting may be shrunk onto the first sealing disk, and the second mounting may be shrunk onto the second sealing disk.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
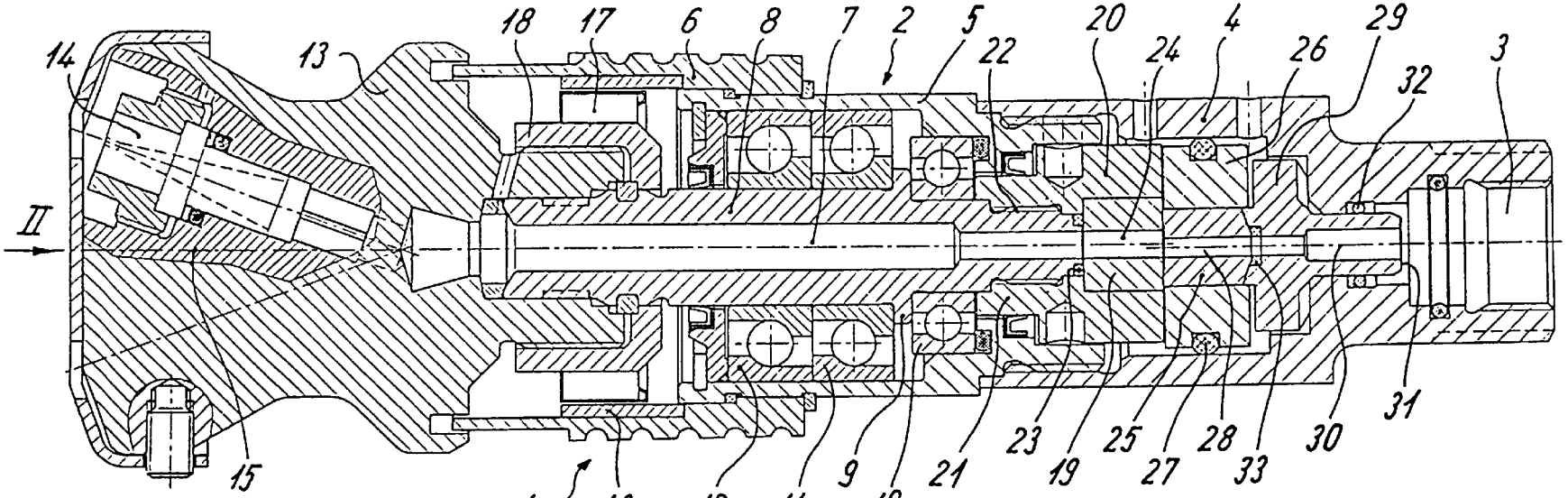
FIG. 1 is a longitudinal sectional view of a nozzle head according to the present invention.

Throughout all the Figures, same or corresponding elements are generally indicated by same reference numerals.

Turning now to the drawing, and in particular to FIG. 1, there is shown a longitudinal section of a nozzle head according to the present invention, generally designated by reference numeral 1. The nozzle head 1 has a stationary, cylindrical housing, generally designated by reference numeral 2 and including a housing part 4 having one end formed in one piece with a pressurized water connection 3, and another end threadably engaged to a central housing part 5. A sleeve-shaped support member 6 is secured onto the housing part 5 and extends the housing part 5 forward for engagement in pockets 13a of a nozzle carrier 13. Centered in the stationary housing 2 is a hollow support 8 which is formed with a central passage 7 in fluid communication with the pressurized water connection 3. The hollow shaft 8 is provided with an annular flange 9 for rotatable support on rolling bearings 10, 11, 12 which are positioned in side-by-side disposition in the central housing part 5.

Figure 2:
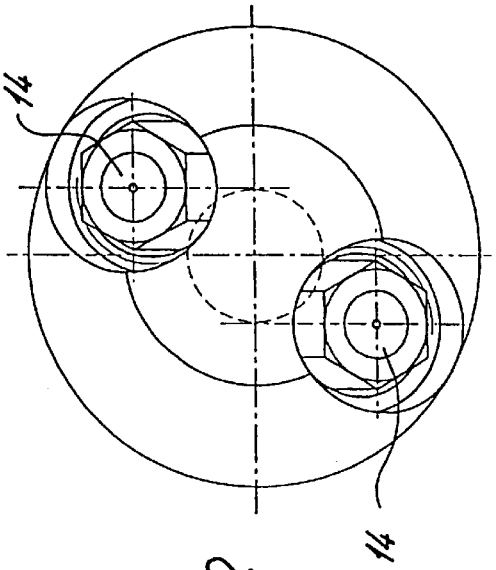
FIG. 2 is a front view of the nozzle head in direction of arrow 11 in FIG. 1

At its end distant to the pressurized water connection 3, the hollow shaft 8 is connected to the nozzle carrier 13 which has incorporated therein a pair of spray nozzles 14 in opposite disposition, as shown in FIG. 2. The spray nozzles 14 are so positioned in the nozzle carrier 13 that their longitudinal axes are inclined with respect to an axis of rotation 15 so that pressurized water exiting the spray nozzles 14 generates a recoil action by which the nozzle carrier 13 is caused to rotate. Deceleration of the rotational motion of the nozzle carrier 13 is effected by a brake mechanism which is accommodated in the support member 6 and includes a copper ring 16 which surrounds permanent magnets 17 at a slight distance thereto, with the permanent magnets 17 being secured to a ring member 18. The permanent magnets 17 and the copper ring 16 form together an eddy current brake for braking the rotational movement of the nozzle carrier 13.

Arranged at the nozzle carrier distant end of the hollow shaft 8 is a sealing disk 19 which is made from highly wear-resistant material, e.g. ceramics or wear-resistant bearing material and secured by a, preferably cylindrical, mounting 20 to the hollow shaft 8. The mounting 20 is preferably made of steel and formed in one piece with a stub 21 that juts out and is formed with an internal thread for meshing an external thread on the hollow shaft 8, thereby retaining the sealing disk 19 in place. Thus, the sealing disk 19 moves conjointly with the nozzle carrier 13 and the hollow shaft 8. Positioned between the sealing disk 19 and the adjacent end face of the hollow shaft 8 is a sealing ring 23 made of rubber or plastics and received in a pocket of the hollow shaft 8 for circumscribing the central passage 7 of the hollow shaft 8. The sealing disk 19 is formed with a central passage 24 which is in alignment and fluidly connected to the adjacent central passage 7 of the hollow shaft 8.

At its pressurized water connection proximal end, the sealing disk 19 is supported by a further sealing disk 25 which is also made of highly wear-resistant material, e.g. ceramics or wear-resistant bearing material and received in a, preferably cylindrical, mounting 26 for securement. The mounting 26 may be made of steel and is mounted in the stationary housing part 4 by a sealing ring 27 which is clamped between the mounting 26 and an adjacent inside wall surface of the housing part 4.

Suitably, the interfaces between the sealing disks 29 and 25 are superfinished, preferably polished.

As indicated in the nonlimiting example of FIG. 1, the longitudinal axes of the central passages 24, 28 of the sealing disks 19, 25 are slightly offset to one another, e.g. by about 1 mm, thereby improving the wear resistance of the sealing disk 19, 25. Suitably, the pressurized water connection proximal end face of the sealing disk 25 exhibits a convex configuration for interaction with an adjacent concave end face of a support body 29 which terminates the sealing assembly at the nozzle carrier distant end of the nozzle head 1. The support body 29 is formed with a central, stepped bore 30 and so received in the housing part 4 as to be slidable therein with a slight stroke. Pressurized water incoming through the connection 3 acts upon the end face 31 of the support body 29 that is distant to the sealing disk 25 to force the support body 29 in press fit with the convex end face of the sealing disk 25. The end face 31 of the support body 29 subject to the pressurized water is sealed from the outside by a seal ring 32 which is received in a pocket of the housing part 4. A further seal ring 33 is accommodated in a pocket of the support body 29 in an area adjacent the sealing disk 25 and circumscribes the central bore 30 of the support body 29. Preferably, the seal ring 33 is made of rubber or plastics.

Persons skilled in the art will understand that the present invention should not be limited to a nozzle carrier that is driven by recoil caused by pressurized water as a consequence of the disposition of the spray nozzles, as other means, e.g. a motor integrated in the nozzle head, may be equally applicable in order to effect a rotation the nozzle carrier.

In order to secure the sealing disks 19, 25 in respective receptacles of the mountings 20, 26, it may be suitable to shrink the mountings 20, 26 onto the sealing disks 19, 25, whereby the shrinkage forces acting radially for securement of the sealing disks 19, 25 in the receptacles of the mountings 20, 26 should exceed the forces applied by the pressure medium.

While the invention has been illustrated and described as embodied in a nozzle head with improved wear-resistant and sealing properties, it is not intended to be limited to the details shown since various modifications and structural changes may be made without departing in any way from the spirit of the present invention.

What is claimed as new and desired to be protected by Letters Patent is set forth in the appended claims:

1. A nozzle head assembly, comprising:

a driven nozzle carrier supported for rotation about a longitudinal axis and provided with spray nozzles;

a stationary housing formed with a pressurized water connection;

a shaft rotatably supported in the housing and secured to the nozzle carrier, said shaft having a central passage for conducting pressurized water to the spray nozzles; and a sealing assembly positioned at a nozzle carrier distal end face of the shaft and including a first sealing disk of highly wear-resistant material, said first sealing disk bearing upon the nozzle carrier distal end face of the shaft and formed with a central passage, a first mounting for so securing the first sealing disk to the shaft as to allow a conjoint movement with the nozzle carrier and the shaft, a second sealing disk made of highly wear-resistant material, said first sealing disk having a pressurized water connection proximate end face which bears upon an end face of the second sealing disk, and a second mounting fixed in the housing for placement upon the second sealing disk, wherein the central passages of the shaft and the first sealing disk are slightly offset to one another.

2. The nozzle head of claim 1 wherein the first and second mountings are each made of steel.

3. The nozzle head of claim 1 wherein the first and second mountings are each formed as cylindrical bodies.

4. The nozzle head of claim 1 wherein the first mounting has a threaded stub provided with an internal thread for meshing with an external thread of the shaft.

5. The nozzle head of claim 1 wherein the assembly has a sealing ring for non-rotatably securing the second mounting in the stationary housing.

6. The nozzle head of claim 1 wherein the interacting end faces of the first and second sealing disks are superfinished.

7. The nozzle head of claim 6 wherein the end faces of the first and second sealing disks are polished.

8. The nozzle head of claim 1 wherein the central passages of the shaft and the first sealing disk are offset to one another by 1 mm.

9. The nozzle head of claim 1 wherein the first and second sealing disks are made of a material selected from the group consisting of ceramics and a wear-resistant bearing material.

10. The nozzle head of claim 1 wherein the first mounting is shrunk onto the first sealing disk, and the second mounting is shrunk onto the second sealing disk.

11. A nozzle head assembly, comprising:

a driven nozzle carrier supported for rotation about a longitudinal axis and provided with spray nozzles;

a stationary housing formed with a pressurized water connection;

a shaft rotatably supported in the housing and secured to the nozzle carrier, said shaft having a central passage for conducting pressurized water to the spray nozzles; and a sealing assembly positioned at a nozzle carrier distal end face of the shaft and including a first sealing disk of highly wear-resistant material, said first sealing disk bearing upon the nozzle carrier distal end face of the shaft and formed with a central passage, a first mounting for so securing the first sealing disk to the shaft as to allow a conjoint movement with the nozzle carrier and the shaft, a second sealing disk made of highly wear-resistant material, said first sealing disk having a pressurized water connection proximate end face which bears upon an end face of the second sealing disk, and a second mounting fixed in the housing for placement upon the second sealing disk, wherein the second sealing disk has another end face directed toward the pressurized water connection and shaped of convex configuration, said assembly including a support body having an end face exhibiting a concave configuration and bearing upon the convex end face of the second sealing disk.

12. The nozzle head of claim 11 wherein the first and second mountings are each made of steel.

13. The nozzle head of claim 11 wherein the first and second mountings are each formed as cylindrical bodies.

14. The nozzle head of claim 11 wherein the first mounting has a threaded stub provided with an internal thread for meshing with an external thread of the shaft.

15. The nozzle head of claim 11 wherein the assembly has a sealing ring for non-rotatably securing the second mounting in the stationary housing.

16. The nozzle head of claim 11 wherein the interacting end faces of the first and second sealing disks are superfinished.

17. The nozzle head of claim 16 wherein the end faces of the first and second sealing disks are polished.

18. The nozzle head of claim 11 wherein the support body is so mounted in the housing as to be slidable by a slight stroke and has another end face which is proximate to the pressure water connection and acted upon by pressure water.

19. The nozzle head of claim 18 wherein the sealing assembly includes a seal ring positioned in a receptacle of the housing for bounding the other end face of the support body toward the outside.

20. The nozzle head of claim 17 wherein the support body is formed with a central passage, said sealing assembly including a seal ring positioned between the support body and the second sealing disk, said seal ring being made of a material selected from the group consisting of rubber and plastics, and so received in a receptacle of the support body as to circumscribe the central passage of the support body.

21. The nozzle head of claim 11 wherein the first and second sealing disks are made of a material selected from the group consisting of ceramics and a wear-resistant bearing material.

22. The nozzle head of claim 11 wherein the first mounting is shrunk onto the first sealing disk, and the second mounting is shrunk onto the second sealing disk.

23. A nozzle head assembly, comprising:

a driven nozzle carrier supported for rotation about a longitudinal axis and provided with spray nozzles;

a stationary housing formed with a pressurized water connection;

a shaft rotatably supported in the housing and secured to the nozzle carrier, said shaft having a central passage for conducting pressurized water to the spray nozzles; and a sealing assembly positioned at a nozzle carrier distal end face of the shaft and including a first sealing disk of highly wear-resistant material, said first sealing disk bearing upon the nozzle carrier distal end face of the shaft and formed with a central passage, a first mounting for so securing the first sealing disk to the shaft as to allow a conjoint movement with the nozzle carrier and the shaft, a second sealing disk made of highly wear-resistant material, said first sealing disk having a pressurized water connection proximate end face which bears upon an end face of the second sealing disk, and a second mounting fixed in the housing for placement upon the second sealing disk, wherein the sealing assembly includes a seal ring positioned in a receptacle of the shaft between the first sealing disk and the adjacent end face of the shaft and being made of a material selected from the group consisting of rubber and plastics.

24. The nozzle head of claim 23 wherein the first and second mountings are each made of steel.

25. The nozzle head of claim 23 wherein the first and second mountings are each formed as cylindrical bodies.

26. The nozzle head of claim 23 wherein the first mounting has a threaded stub provided with an internal thread for meshing with an external thread of the shaft.

27. The nozzle head of claim 23 wherein the assembly has a sealing ring for non-rotatably securing the second mounting in the stationary housing.

28. The nozzle head of claim 23 wherein the interacting end faces of the first and second sealing disks are superfinished.

29. The nozzle head of claim 28 wherein the end faces of the first and second sealing disks are polished.

30. The nozzle head of claim 23 wherein the first and second sealing disks are made of a material selected from the group consisting of ceramics and a wear-resistant bearing material.

31. The nozzle head of claim 23 wherein the first mounting is shrunk onto the first sealing disk, and the second mounting is shrunk onto the second sealing disk.

* * * * *